US008926132B2

(12) United States Patent
Horng et al.

(10) Patent No.: US 8,926,132 B2
(45) Date of Patent: Jan. 6, 2015

(54) LAMP

(71) Applicant: Sunonwealth Electric Machine Industry Co., Ltd., Kaohsiung (TW)

(72) Inventors: Alex Horng, Kaohsiung (TW); Yu-Yuan Lu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 23 days.

(21) Appl. No.: 13/778,244

(22) Filed: Feb. 27, 2013

(65) Prior Publication Data

US 2014/0140063 A1 May 22, 2014

(30) Foreign Application Priority Data

Nov. 16, 2012 (TW) ..... 101142949 A

(51) Int. Cl.

| | |
|---|---|
| ***F21S 4/00*** | (2006.01) |
| ***F21V 21/00*** | (2006.01) |
| ***F21V 29/02*** | (2006.01) |
| ***F21V 33/00*** | (2006.01) |
| ***F21K 99/00*** | (2010.01) |
| ***F21V 23/00*** | (2006.01) |
| ***F24F 3/056*** | (2006.01) |
| *F21Y 101/02* | (2006.01) |
| *F24F 3/16* | (2006.01) |

(52) U.S. Cl.

CPC ..... *F21V 29/02* (2013.01); *F21V 33/00* (2013.01); *F21K 9/135* (2013.01); *F21V 23/00* (2013.01); *F24F 3/056* (2013.01); *F21Y 2101/02* (2013.01); *F24F 2003/1682* (2013.01); *F24F 2003/1685* (2013.01); *Y10S 362/80* (2013.01)

USPC ..... 362/249.02; 362/294; 362/800

(58) Field of Classification Search

CPC ..... F21V 33/00; F21V 29/00; F21V 21/00; F21V 29/02; A62B 7/08; F21K 9/135; F21Y 2101/02; F24F 2003/1682; F24F 2003/1685

USPC ..... 362/249.01, 249.02, 294, 373, 800

See application file for complete search history.

(56) References Cited

U.S. PATENT DOCUMENTS 5,779,769 A * 7/1998 Jiang ..... 96/55
8,487,517 B2 7/2013 Fang et al.

(Continued)

FOREIGN PATENT DOCUMENTS

CN 101358724 B 5/2011
EP 2500622 9/2012

(Continued)

*Primary Examiner* — Jason Moon Han

(74) *Attorney, Agent, or Firm* — Alan D. Kamrath; Kamrath IP Lawfirm, P.A.

(57) ABSTRACT

A lamp includes a housing having a solid peripheral wall between an opening and an electrical connector respectively at two ends of the housing, maintaining the appearance integrity of the lamp. A cooling module is fixed in the housing. At least one wind channel is defined between the cooling module and the opening of the housing. A light-emitting element is coupled to the cooling module. A circuit board is fixed in the housing and electrically connected to the electrical connector and the light-emitting element. An air cleaner includes a generator body and at least one emitter. An air passage is defined between an inner face of the solid peripheral wall of the housing, the cooling module and the circuit board. The at least one emitter of the air cleaner is mounted in the air passage, providing enhanced air cleaning effect.

15 Claims, 4 Drawing Sheets

(56) References Cited

U.S. PATENT DOCUMENTS

| | | | | |
|---|---|---|---|---|
| 2003/0095902 | A1* | 5/2003 | Lee et al. | 422/306 |
| 2009/0049985 | A1* | 2/2009 | Leroux et al. | 95/79 |
| 2010/0232168 | A1* | 9/2010 | Horng et al. | 362/373 |
| 2010/0295436 | A1* | 11/2010 | Horng et al. | 313/46 |
| 2012/0062095 | A1 | 3/2012 | Horng | |
| 2012/0113647 | A1* | 5/2012 | Lee | 362/253 |

FOREIGN PATENT DOCUMENTS

| | | | |
|---|---|---|---|
| JP | 2002-159880 | | 6/2002 |
| JP | 2004-22195 | | 1/2004 |
| JP | 2005228503 | A | 8/2005 |
| KR | 10-0819376 | | 4/2008 |
| KR | 20120094285 | A | 8/2012 |

* cited by examiner

LAMP

BACKGROUND OF THE INVENTION

1. Field of the Invention

The present invention relates to a lamp and, more particularly, to a lamp for generating negative ions or ozone for cleaning air.

2. Description of the Related Art

Lamps available in the market, such as light-emitting diode (LED) lamps, generally provide an illumination effect without designs for cleaning air or removing indoor odors, providing limited utility. Lamps with an air cleaning effect have been proposed.

An example of an LED lamp with an air cleaning effect is disclosed in China Patent Application No. 200810071797.9. With reference to FIG. 1, the LED lamp 9 includes a housing 91 having upper and lower air holes 911 and 912 in upper and lower portions thereof. A heat sink 92, a fan 93 and a light-emitting member 94 are mounted in the housing 91. A negative ion generator 95 is mounted in an air passage between the heat sink 92 and the fan 93. In use, negative ions generated by the negative ion generator 95 are sent outside of the housing 91 for cleaning the air.

However, the upper air holes 911 in the peripheral wall of the housing 91 destroy the integrity and beauty of the appearance of the lamp 9. Furthermore, ambient dust is liable to enter an interior of the housing 91 via the upper air holes 911, and the accumulated dust adversely affects the cooling effect and the air cleaning effect of the lamp 9.

Furthermore, in a case that the housing 91 of the lamp 9 is mounted in a space above a decorative ceiling or the like for aesthetic decoration purposes, air circulation between the interior of the housing 91 and ambient air is poor while adversely affecting the air cleaning effect of the negative ions.

Furthermore, the negative ion generator 95 of the lamp 9 is mounted between the heat sink 92 and the fan 93 and, thus, occupies a considerable space of the air passage, adversely affecting the air guiding effect of the fan 93.

SUMMARY OF THE INVENTION

An objective of the present invention is to solve the above disadvantages of the conventional lamps by providing a lamp including a solid peripheral wall free of air inlets or air outlets, such that the lamp has appearance integrity while providing an air cleaning effect.

Another objective of the present invention is to provide a lamp preventing dust from entering an interior of the lamp, avoiding accumulation of dust in the interior of the lamp and providing an enhanced cooling effect and an enhanced air cleaning effect.

A further objective of the present invention is to provide a lamp having a split type air cleaner to avoid the air cleaner from occupying too much space of an air passage in the lamp.

The present invention fulfills the above objective by providing a lamp including a housing having first and second ends. An electrical connector is provided on the first end of the housing. The second end of the housing defines an opening. The housing includes a closed peripheral wall between the opening and the electrical connector. A cooling module is fixed in the housing. At least one wind channel is defined between the cooling module and the opening of the housing. A light-emitting element is coupled to the cooling module. A circuit board is fixed in the housing and electrically connected to the electrical connector and the light-emitting element. An air cleaner includes a generator body and at least one emitter electrically connected to the generator body. An air passage is defined between an inner face of the solid peripheral wall of the housing, the cooling module and the circuit board. The at least one emitter of the air cleaner is mounted in the air passage. The appearance integrity of the lamp is maintained, while providing an enhanced cooling effect and an enhanced air cleaning effect.

Preferably, the cooling module includes a heat sink and a fan coupled to the heat sink. The heat sink is fixed in the housing. The fan is coupled to the heat sink. The light-emitting element is coupled to the heat sink. The fan includes an air inlet and an air outlet for guiding air currents into and out of the fan. Thus, the negative ions generated by the air cleaner can cooperate with the fan to provide an enhanced circulating effect for the ambient air.

The at least one emitter of the air cleaner can be electrically connected to the generator body by a wire, such that the at least one emitter of the air cleaner can be located in any desired position in the air passage, providing assembly tolerance.

Preferably, a light-transmittable cover is mounted to the heat sink, and the light-emitting element is received in the light-transmittable cover. In an example, the heat sink includes a first engagement portion, and the light-transmittable cover includes a second engagement portion engaged with the first engagement portion, providing easy assembly.

The generator body of the air cleaner can be coupled to the circuit board. The generator body of the air cleaner can be a module coupled to the circuit board. Alternatively, the generator body of the air cleaner includes a circuitry formed on the circuit board by layout. Thus, the air cleaner does not occupy too much space of the air passage, providing an enhanced guiding effect for the air currents.

The generator body of the air cleaner can be electrically connected to the circuit board or the electrical connector of the housing.

The air cleaner can be a negative ion generator or an ozone generator.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

Figure 1:
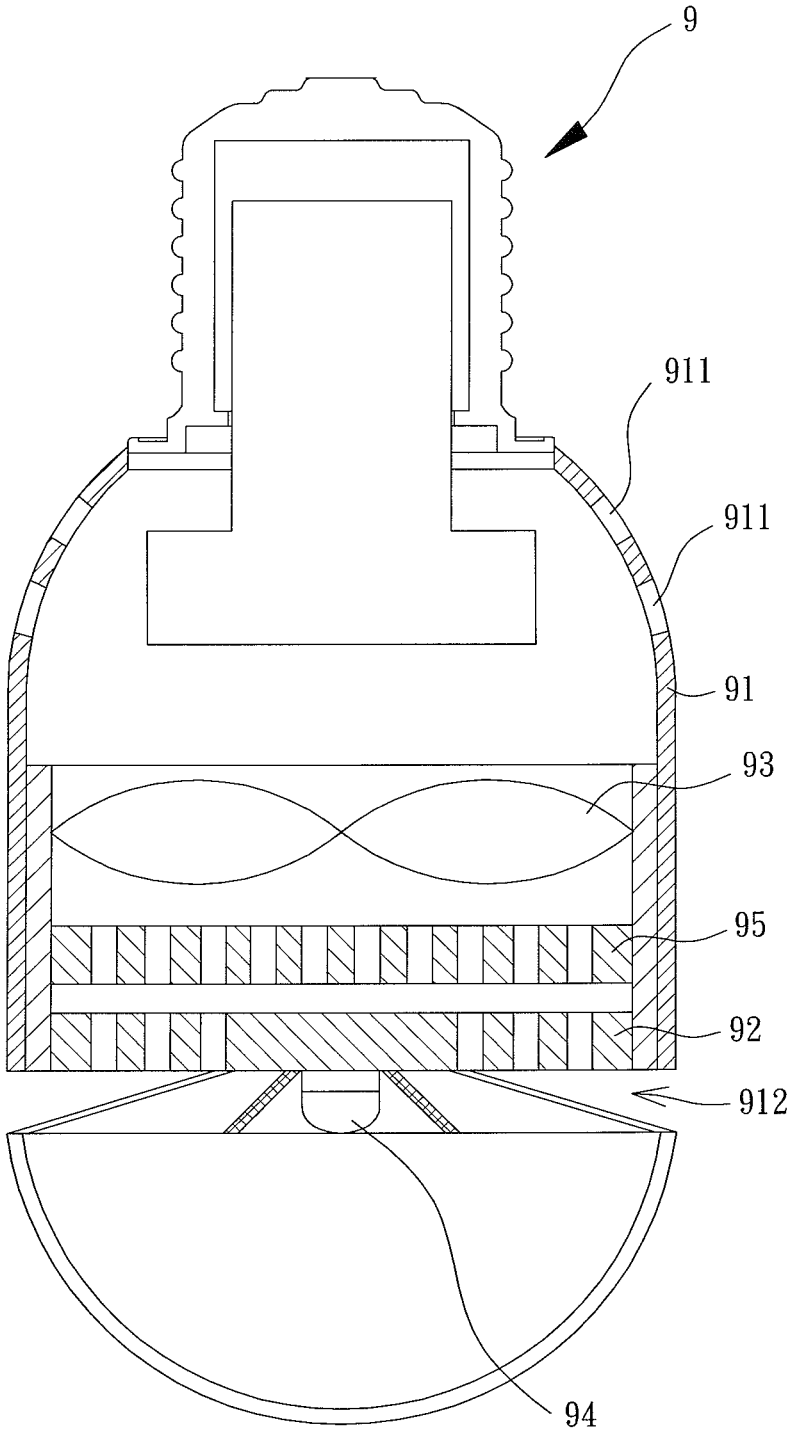
FIG. 1 PRIOR ART
FIG. 1 is a cross sectional view of a conventional lamp.
Figure 2:
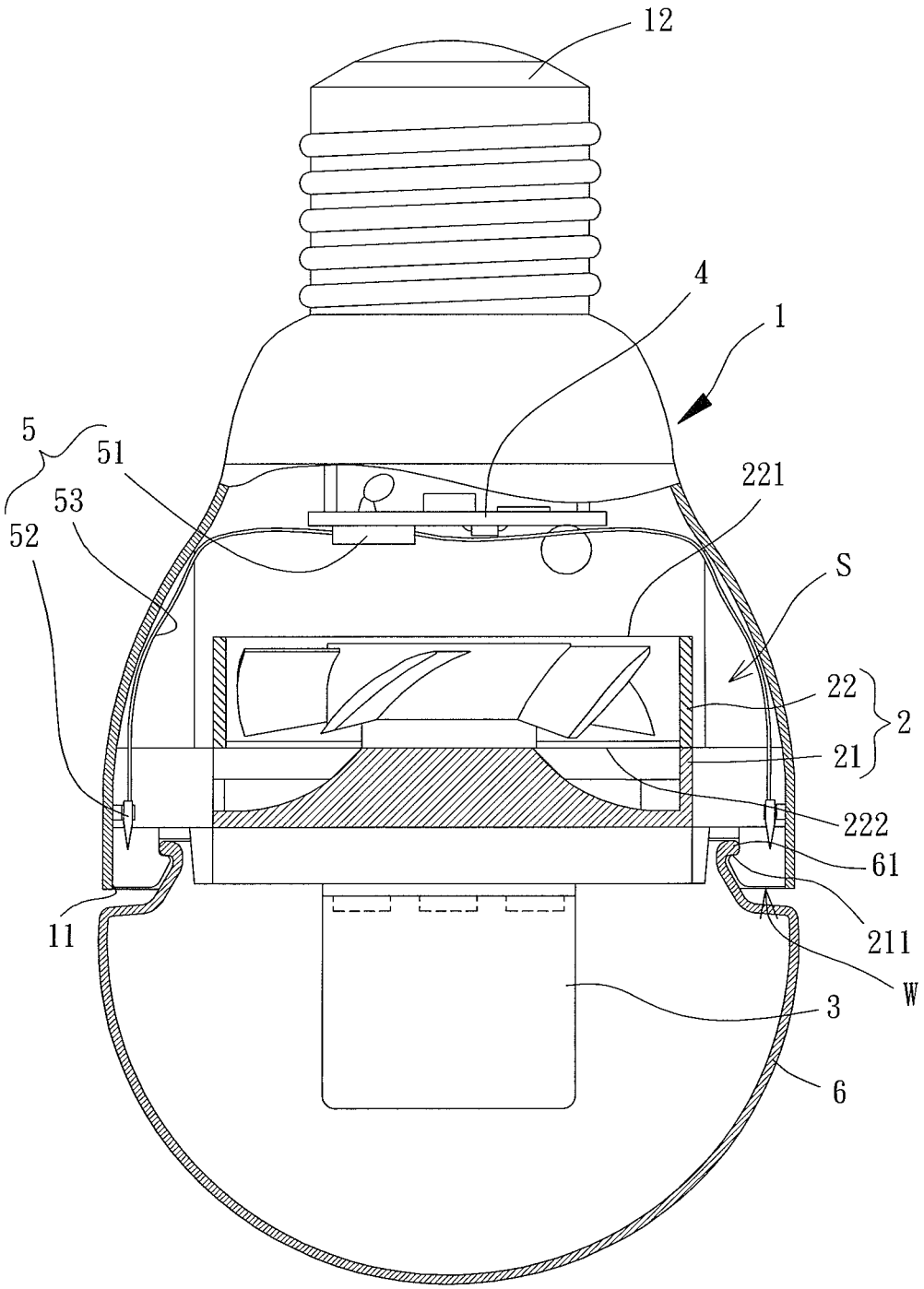
FIG. 2 is a cross sectional view of a lamp of a first example according to the present invention.

With reference to FIG. 2, a lamp of a preferred embodiment according to the present invention includes a housing 1, a cooling module 2, a light-emitting element 3, a circuit board 4 and an air cleaner 5. The housing 1 is used to couple with the cooling module 2, the circuit board 4, and the air cleaner 5, such that the cooling module 2, the circuit board 4, and the air cleaner 5 are received in the housing 1. The light-emitting element 3 is coupled to the cooling module 2. The circuit board 4 is electrically connected to the light-emitting element 3 and the air cleaner 5.

An electrical connector 12 is provided on a first end of the housing 1. A second end of the housing 1 opposite to the first end defines an opening 11 for communicating an interior of the housing 1 with the outside, allowing the cooling module 2, the circuit board 4, and the air cleaner 5 to be mounted into the interior of the housing 1 while allowing ambient air currents to flow from the outside into the interior of the housing 1 to provide the predetermined cooling effect for the light-emitting element 3. The electrical connector 12 can be of any structural design for electrical connection with an external power source, serving as the main power source for the lamp.

In the preferred embodiment, the housing 1 includes a solid peripheral wall between the opening 11 and the electrical connector 12. Namely, the solid peripheral wall is free of through-holes.

The cooling module 2 is fixed into the housing 1 via the opening 11. The cooling module 2 and the housing 1 can be coupled with each other by a threading coupling, a male/female engagement, gluing or welding. At least one wind channel W is defined between the cooling module 2 and the opening 11 of the housing 1, as shown in FIG. 2.

In the preferred embodiment, the cooling module 2 includes a heat sink 21 and a fan 22. The heat sink 21 is made of a thermally conductive material and fixed in the housing 1. The fan 22 is coupled to the heat sink 21. The fan 22 can be electrically connected to the circuit board 4. The fan 22 can be of an axial flow type or a centrifugal type. Preferably, the fan 22 is of an axial flow type. The fan 22 includes an air inlet 221 and an air outlet 222 for guiding air currents into and out of the fan 22. Thus, the fan 22 can cooperate with the heat sink 21 to provide the predetermined cooling effect.

The light-emitting element 3 is coupled to the cooling module 2. In a case that the cooling module 2 includes the heat sink 21, the light-emitting element 3 can be coupled to the heat sink 21 to provide enhanced cooling effect.

The circuit board 4 can be fixed in the housing 1 by fasteners, such as screws. The circuit board 4 is electrically connected to the electrical connector 12 and the light-emitting element 3 to provide power during the operation of the light-emitting element 3 while controlling the operation of the light-emitting element 3.

An air passage S is defined between an inner face of the solid peripheral wall of the housing 1, the cooling module 2 and the circuit board 4. Namely, the air passage S is located in the housing 1 but outside of the cooling module 2 and the circuit board 4. The at least one wind channel W communicates the air passage S with the outside, allowing intake and outtake of wind.

The air cleaner 5 can be a negative ion generator or an ozone generator. The air cleaner 5 includes a generator body 51 and at least one emitter 52. The generator body 51 is electrically connected to the circuit board 4 or the electrical connector 12 of the housing 1. Preferably, the generator body 51 is directly mounted to the circuit board 4. As an example, the generator body 51 can be integrated as a module and then mounted to the circuit board 4. In another example, the generator body 51 includes a circuitry directly formed on the circuit board 4 by layout. Thus, the air cleaner 5 will not occupy too much space in the air passage S. The at least one emitter 52 is in the air passage S and electrically connected to the generator body 51 by a wire 53. Thus, the at least one emitter 52 can be located in any desired position in the air passage S. Thus, the generator body 51 and the at least one emitter 52 of the air cleaner 5 are of a split type in which only the at least one emitter 52 is located in the air passage S.

In use, the lamp can be mounted to a wall, a ceiling or any place requiring illumination. As an example, the housing 1 of the lamp can be mounted in a space above a decorative ceiling or the like for aesthetic decoration purposes, with only the opening 11, the at least one wind channel W and the light-emitting element 3 exposed outside of the decorative ceiling to provide illumination and excellent cooling effect while avoiding dust from entering the housing 1. In a case that the air cleaner 5 is a negative ion generator, the generator body 51 of the air cleaner 5 can use pulses or an oscillator circuit to convert a low voltage into a DC negative high voltage, thereby ionizing the air currents near the at least one emitter 52 into negative ions. Thus, the dust, pollen and smoke in the air carry static charges and are, thus, liable to be attracted by and fall to the ground, achieving the air cleaning effect. In another case that the air cleaner 5 is an ozone generator, the generator body 51 converts a low voltage into an AC high voltage through a transformer, forming a high-voltage electric field between the emitters 52, ionizing the oxygen molecules in the air into oxygen ions. The oxygen ions combine with the oxygen molecules in the air to form ozone, providing the air cleaning effect including disinfection and deodorization.

Based on the above technical concept, the air cleaner 5 can provide the functions of both of a negative ion generator and an ozone generator, which can be appreciated by one skilled in the art.

The arrangement of the at least one emitter 52 of the air cleaner 5 can be exemplified in several examples.

With reference to FIG. 2, the at least one emitter 52 is located in a position of the air passage S adjacent to the at least one wind channel W. Thus, the air cleaning effect of the ambient air is improved when the air cleaner 5 generates negative ions.

Figure 3:
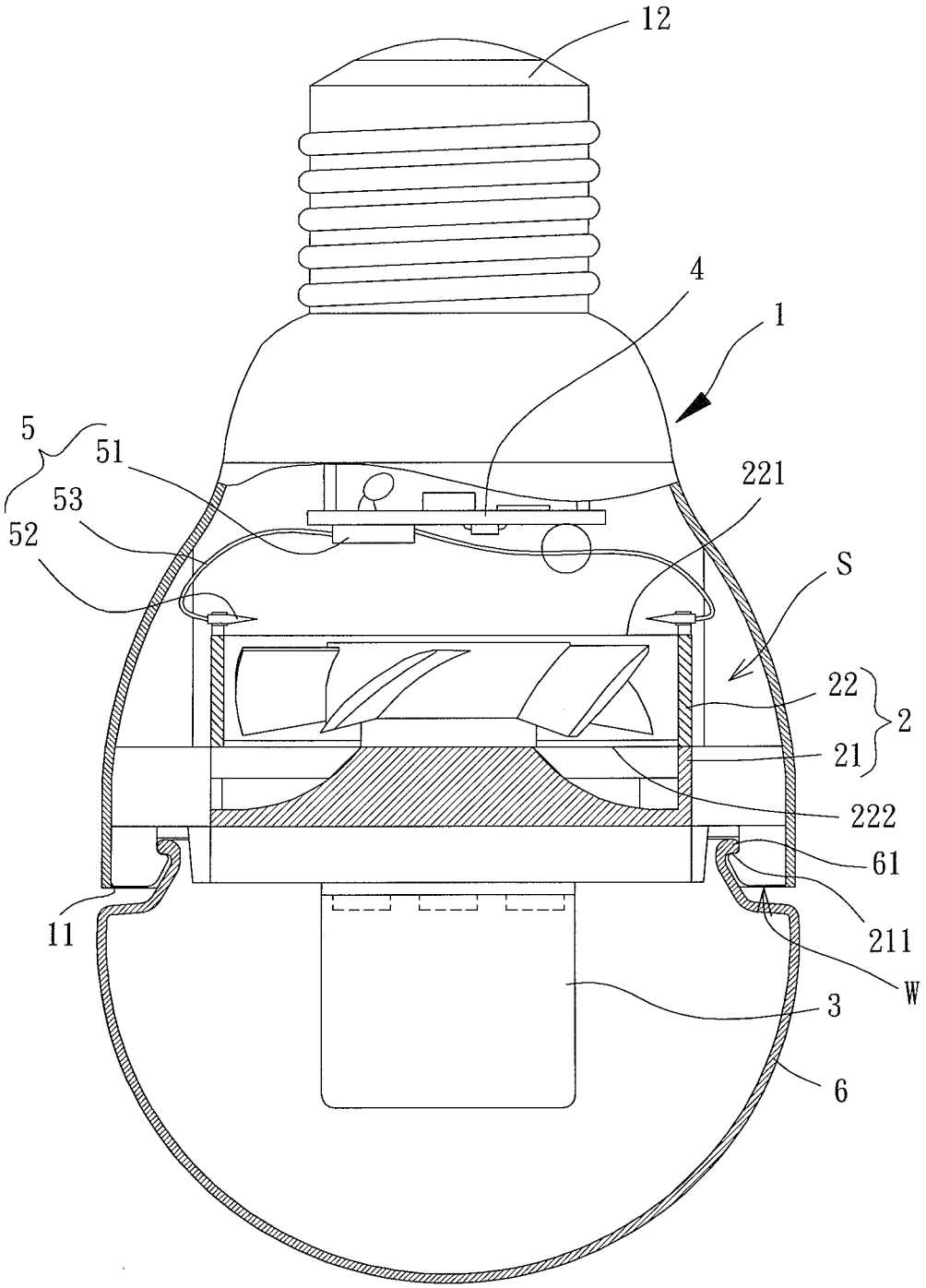
FIG. 3 is a cross sectional view of a lamp of a second example according to the present invention.
Figure 4:
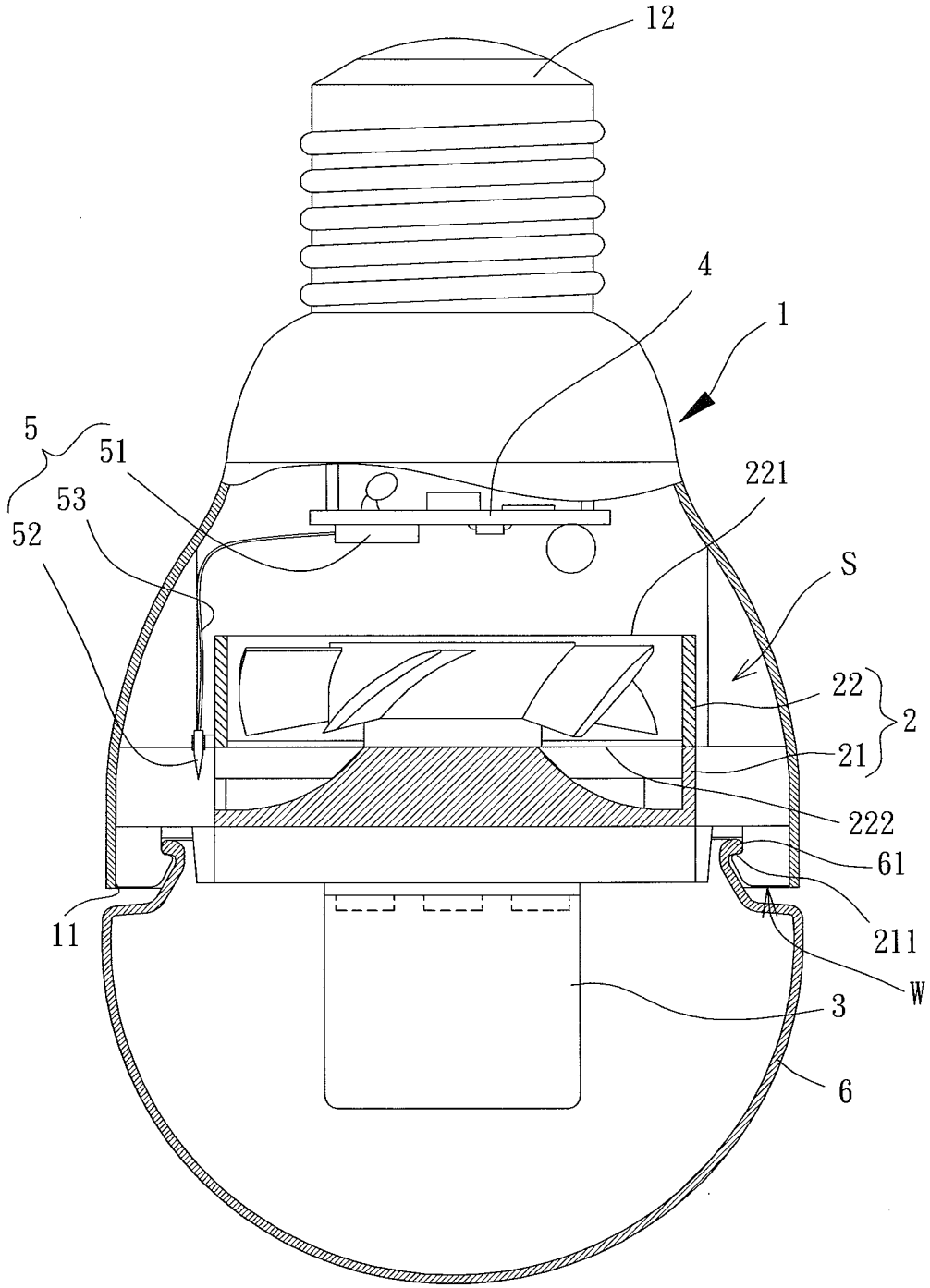
FIG. 4 is a cross sectional view of a lamp of a third example according to the present invention.

With reference to FIG. 3, in a case that the cooling module 2 includes the cooling fan 22, the at least one emitter 52 is located in a position of the air passage S adjacent to the air inlet 221 of the fan 22. Thus, an improved air cleaning effect can be obtained by cooperation of the negative ions generated by the air cleaner 5 with the air currents guided by the fan 22.

With reference to FIG. 3, in a case that the cooling module 2 includes the cooling fan 22, the at least one emitter 52 is located in a position of the air passage S adjacent to the air outlet 222 of the fan 22. Since the at least one emitter 52 is located adjacent to the fan 22, an improved air cleaning effect can be obtained by cooperation of the negative ions generated by the air cleaner 5 with the air currents guided by the fan 22.

With reference to FIG. 2, the lamp according to the present invention preferably includes a light-transmittable cover 6 mounted to the heat sink 21 of the cooling module 2. The light-emitting element 3 is received in the light-transmittable cover 6, providing protection for the light-emitting element 3. The light-transmittable cover 6 and the heat sink 21 of the cooling module 2 can be coupled with each other by a threading coupling, a male/female engagement, gluing or welding. In the embodiment shown, the heat sink 21 of the cooling module 2 includes a first engagement portion 211, and the light-transmittable cover 6 includes a second engagement portion 61 in an open end edge thereof. The second engagement portion 61 can be affixed to or disengaged from the first engagement portion 211 to provide easy attachment.

The lamp according to the present invention provides the following advantages. Firstly, processing for forming air inlets or air outlets on the solid peripheral wall between the opening 11 and the electrical connector 12 of the housing 1 is not required. Nevertheless, the negative ions or ozone generated by the air cleaner 5 can clean the ambient air via the opening 11. Thus, the appearance integrity and aesthetic appearance of the lamp are maintained while providing an air cleaning effect.

The solid peripheral wall of the housing 1 is free of through-holes, effectively reducing the amount of dust falling into the housing 1 via the solid peripheral wall and reducing accumulation of dust in the lamp. Normal operation of the air cleaner 5 is assured. Thus, the lamp provides an enhanced cooling effect as well as an enhanced air cleaning effect.

The generator body 51 and the at least one emitter 52 of the air cleaner 5 are of a split type, and only the at least one emitter 52 is located in the air passage S. Thus, the air cleaner 5 does not occupy too much space in the air passage S, assuring the cooling effect of the cooling module 2 and prolonging the service life of the lamp.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A lamp comprising:

a housing including first and second ends, with an electrical connector provided on the first end of the housing, with the second end of the housing defining an opening, with the housing including a solid peripheral wall between the opening and the electrical connector, and with the solid peripheral wall being free of through holes or vents;

a cooling module fixed in the housing, with at least one wind channel defined between the cooling module and the opening of the housing;

a light-emitting element coupled to the cooling module;

a circuit board fixed in the housing and electrically connected to the electrical connector and the light-emitting element, with the circuit board located intermediate the electrical connector and the opening; and an air cleaner including a generator body and at least one emitter electrically connected to the generator body, wherein the air cleaner is at least one of a negative ion generator and an ozone generator, with an air passage defined between an inner face of the solid peripheral wall of the housing, the cooling module and the circuit board and located intermediate the opening and the electrical connector, with the cooling module, the circuit board and the air cleaner being coextensive to the air passage, and with the at least one emitter of the air cleaner disposed in the air passage.

2. The lamp as claimed in claim 1, with the cooling module including a heat sink and a fan coupled to the heat sink, with the heat sink fixed in the housing and located intermediate the electrical connector and the opening, with the light-emitting element coupled to the heat sink, and with the fan including an air inlet and an air outlet for guiding air currents into and out of the fan.

3. The lamp as claimed in claim 1, wherein the at least one emitter of the air cleaner is located in a position of the air passage adjacent to the at least one wind channel and intermediate the electrical connector and the opening.

4. The lamp as claimed in claim 2, wherein the at least one emitter of the air cleaner is located in a position of the air passage adjacent to the air inlet of the fan and intermediate the electrical connector and the opening.

5. The lamp as claimed in claim 2, wherein the at least one emitter of the air cleaner is located in a position of the air passage adjacent to the air outlet of the fan and intermediate the electrical connector and the opening.

6. The lamp as claimed in claim 1, wherein the at least one emitter of the air cleaner is electrically connected to the generator body by a wire.

7. The lamp as claimed in claim 2, further comprising: a light-transmittable cover mounted to the heat sink, with the light-emitting element received in the light-transmittable cover.

8. The lamp as claimed in claim 7, wherein the heat sink includes a first engagement portion, wherein the light-transmittable cover includes a second engagement portion, and wherein the second engagement portion is engaged with the first engagement portion.

9. The lamp as claimed in claim 1, wherein the generator body of the air cleaner is coupled to the circuit board.

10. The lamp as claimed in claim 9, wherein the generator body of the air cleaner is a module mounted to the circuit board.

11. The lamp as claimed in claim 9, wherein the generator body of the air cleaner includes a circuitry on the circuit board.

12. The lamp as claimed in claim 1, wherein the generator body of the air cleaner is electrically connected to the circuit board.

13. The lamp as claimed in claim 1, wherein the generator body of the air cleaner is electrically connected to the electrical connector of the housing.

14. The lamp as claimed in claim 1, wherein the air cleaner is a negative ion generator.

15. The lamp as claimed in claim 1, wherein the air cleaner is an ozone generator.

* * * * *